United States Patent [19]

Sumigawa

[11] Patent Number: 5,026,308

[45] Date of Patent: Jun. 25, 1991

[54] TWO PIECE SWIVEL BRACKET

[75] Inventor: Yukio Sumigawa, Hamamatsu, Japan

[73] Assignee: Sanshin Kogyo Kabushiki Kaisha, Hamamatsu, Japan

[21] Appl. No.: 365,660

[22] Filed: Jun. 13, 1989

[30] Foreign Application Priority Data

Jun. 13, 1988 [JP] Japan ..... 63-143505

[51] Int. Cl.[5] ..... B63H 21/26

[52] U.S. Cl. ..... 440/61; 440/53; 440/64; 248/640

[58] Field of Search ..... 440/49, 53, 58–64

[56] References Cited

U.S. PATENT DOCUMENTS 4,013,249 3/1977 Meyer ..... 440/61
4,545,770 10/1985 Ferguson ..... 440/61
4,573,931 3/1986 Andersson ..... 440/61
4,666,410 5/1987 Anselm ..... 440/61
4,813,897 3/1989 Newman ..... 440/61
4,889,507 12/1989 Tahara ..... 440/61

*Primary Examiner*—Joseph F. Peters, Jr.
*Assistant Examiner*—Clifford T. Bartz
*Attorney, Agent, or Firm*—Ernest A. Beutler

[57] ABSTRACT

A swivel bracket comprised of two pieces for a tiltable marine drive unit which enables the drive unit to be easily attached to, or detached from, the hull of a marine vessel. The first piece of the swivel bracket is pivotally secured to a clamp bracket which, in turn, is attached to the hull of a marine vessel. The second piece of the swivel bracket is connected at one end to the first piece of the swivel bracket by bolts and is rotatably secured at the other end to the drive unit for steering movement. The first and second pieces of the swivel bracket can be easily separated from each other.

8 Claims, 4 Drawing Sheets

TWO PIECE SWIVEL BRACKET

BACKGROUND OF THE INVENTION

The invention relates to a swivel bracket for a marine drive unit, such as an outboard engine or the outboard drive portion of an inboard/outboard engine system, for boats, rafts and other marine vessels. More particularly, the invention pertains to a swivel bracket comprising two pieces which are capable of being separated from each other.

One type of outboard drive unit is attached to the hull of a marine vessel by a clamp bracket and an elongated swivel bracket secured to the clamp bracket by a tilt shaft that allows the drive unit to be selectively tilted downwardly into, or upwardly out of, the water. This type of swivel bracket is normally used on vessels having a high transom such as a sail boat.

Previous one piece swivel brackets have had certain disadvantages. Because of their length and one piece construction, such swivel brackets have been unable to reduce the difficulties in handling a typical drive drive unit, particularly in attaching the unit to, or detaching the unit from, the hull of a marine vessel.

SUMMARY OF THE INVENTION

In an outboard drive unit having a drive shaft housing, a two piece swivel bracket and means for connecting the two pieces such that the first and second pieces of the swivel bracket are able to be separated from one another so that the outboard drive unit can be easily detached from, or attached to, the hull of a marine vessel.

Preferably, the drive unit is attached to the hull of a marine vessel by a clamp bracket, a two-piece swivel bracket and a tilt shaft. The clamp bracket is secured at one end to the hull by bolts or other suitable connecting means. The first piece of the swivel bracket is pivotally secured to the other end of the clamp bracket by the tilt shaft. The second piece of the swivel bracket is connected at one end to the first piece of the swivel bracket and is rotatably secured at the other end to a steering shaft of the drive shaft housing for steering movement.

DETAILED DESCRIPTION OF THE PREFERRED EMBODIMENTS

For purposes of describing and illustrating the principles and function of the invention, the drawings illustrate an outboard engine unit, generally referred to herein as a drive unit. The invention is not so limited, however, as it is equally applicable to vessels having inboard engines with outboard drive apparatus as well as other vessels having pivotable drive configurations.

Figure 1:
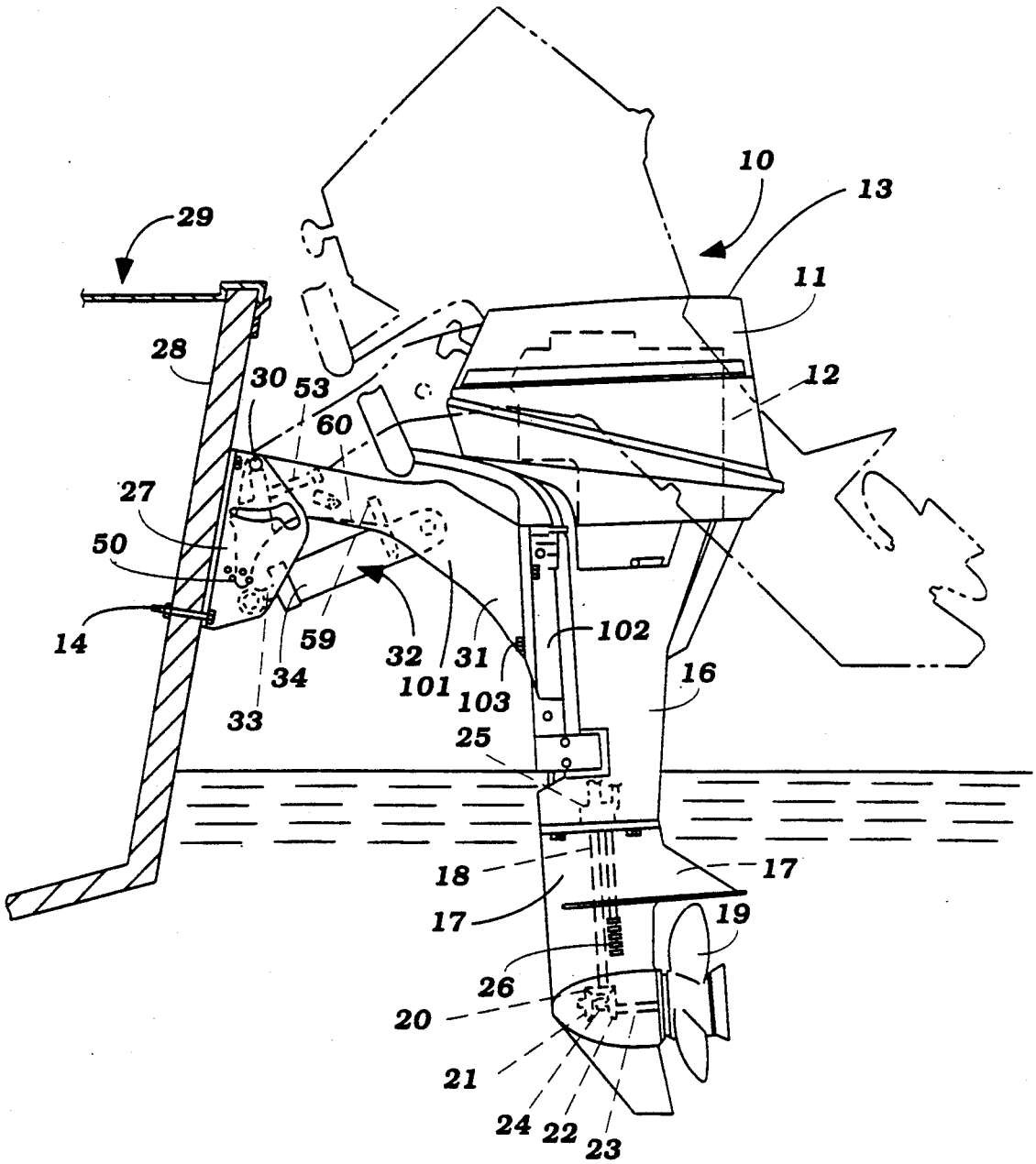
FIG. 1 is a left-side elevational view cut away in part, and parts shown in section of an outboard drive unit embodying the present invention.

FIG. 1 illustrates a typical outboard drive unit 10 having a power head 11 including an engine 12 and a cowling 13, a drive shaft housing 16 including a steering shaft, and a lower unit 17. The lower unit 17 includes a drive shaft 18 which is journaled within the lower unit 17 by means of a support bearing (not shown) and is driven at the upper end thereof by the engine 12 in a known manner.

A forward, neutral, reverse transmission is positioned within the lower unit 17 for selectively driving a propeller 19 in forward or reverse directions. This forward, neutral, reverse transmission is comprised of a driving bevel gear 20 that is affixed to the lower end of the drive shaft 18. The driving bevel gear 20 is in mesh with a pair of counterrotating driven bevel gears 21 and 22. These driven bevel gears 21 and 22 are journaled upon an intermediate shaft (not shown) by means of spaced anti-friction bearings (not shown). The intermediate shaft is connected to the propeller shaft 23, which, in turn, is affixed to the propeller 19 by means of an elastic coupling. Supported on the intermediate shaft is a dog clutching sleeve 24 that has a splined connection to the intermediate shaft for rotation with this shaft and axial movement along it. The dog clutching sleeve 24 has oppositely facing dog clutching teeth that are adapted to cooperate with complementary dog clutching teeth formed on gears 21 and 22 for selectively coupling the gears 21 or 22 for rotation with the intermediate shaft.

The drive unit 10 is provided with a cooling system of the water cooled type. The cooling system includes a circulating pump 25 that is driven by the engine 12 of the drive unit 10 in a suitable manner and which circulates coolant through the engine cooling jacket for discharge back into the body of water in which the watercraft is operating along with the exhaust gases from the engine. The cooling system further includes a water intake port 26 that is formed in the lower unit 17 of the drive unit 10 and which communicates with an internal passageway that is formed within the housing of the lower unit 17 by means of an integral passageway. The integral passageway communicates with the circulating pump 25 by means of a series of conduits.

The drive unit 10 also includes a clamp bracket 27 attached to the hull 28 of a marine vessel 29 by bolts 14, a tilt shaft 30 and a swivel bracket 31 having two pieces 101 and 102. The first piece 101 is pivotally secured at one end to the tilt shaft 30 for movement of the drive unit, 10 between a tilted-down position wherein the propeller 19 is positioned beneath the water and a tilted-up position wherein the propeller 19 is out of the water. The first piece of the swivel bracket 101 is secured at the other end to the second piece of the swivel bracket 102 by bolts 103. The second piece of the swivel bracket 102 is secured at the other end to a steering shaft attached to the drive shaft housing 16 for steering movement.

The outboard drive unit 10 also includes a tilt cylinder device 32, having a rod 33 and a cylinder 34, secured at one end to the clamp bracket 27 and secured at the other end to the swivel bracket 31, to maintain the drive unit 10 in a downward position during normal operation but to permit the drive unit 10 to swing upwardly in the event of a collision with a submerged obstacle. Drive unit 10 is illustrated in solid lines in its down position, and in broken lines in its up or lifted position, in FIG. 1. The outboard drive unit 10 also includes a lower position stop pin 50 for setting the downward position of the swivel bracket 31.

Figure 2:
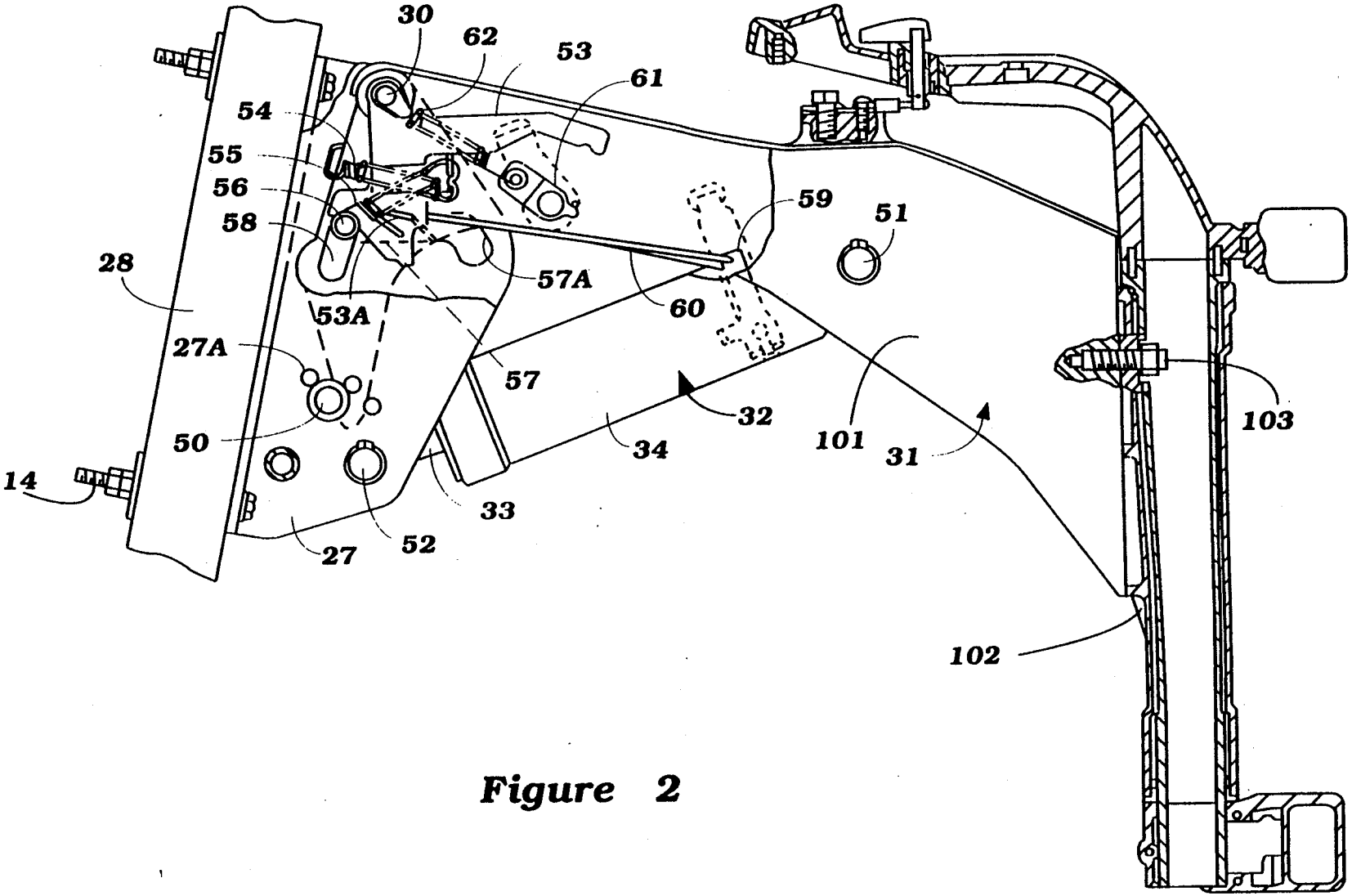
FIG. 2 is a detailed side view, cut away in part and part shown in section of the swivel bracket and a tilt device.

In FIG. 2, the clamp bracket 27 has a series of trim apertures 27A, 27B, 27C and 27D extending laterally therethrough for receiving the lower position stop pin 50 therein for setting the downward position of the swivel bracket 31. Thus, the angle of the drive unit 10 with respect to the hull 28 of the marine vessel 29 may be selectively varied by the operator in accordance with desired operating conditions merely by inserting the lower position stop pin 50 in the appropriate trim aperture 27A, 27B, 27C, or 27D, in the clamp bracket 27.

The tilt cylinder device 32 extendably connects the clamp bracket 27 with the first piece of the swivel bracket 101. The cylinder 34 of the tilt cylinder device 32 is pivotally secured to the first piece of the swivel bracket 101 by a first connecting pin 51. The rod 33 of the tilt cylinder device 32 is pivotally secured to the clamp bracket 27 by a second connecting pin 52.

A tilt lock arm 53 is rotatably supported about the tilt shaft 30. First and second springs 54 and 55 are provided for rotating the lock arm 53 in a lock position when the swivel bracket 31 is in the tilted-up position. When the lock arm 53 is in the lock position, an upper position stop pin 56, engageable with both a clamp bracket slot 57 and a swivel bracket slot 58, is engaged with a stop surface 57A of the clamp bracket slot 57 so that the swivel bracket 31 is prevented from moving. In such a case, the swivel bracket 31 is prevented from moving in the down direction by the action of the upper position stop pin 56. The swivel bracket 31 is prevented from moving toward the up direction by the closure of a bypass valve 36. A lever 59 is connected to the bypass valve 36 for opening and closing the bypass valve 36. A connecting link 60 extends between the lock arm 53 and the lever 59 so that the movement of the lock arm 53 to the lock position causes the bypass valve 36 to be closed.

A manual lever 61 and third spring 62 are provided for shifting the lock arm 53 from the lock position to a release position, thereby allowing the swivel bracket 31 to be rotated to the tilted-down position. In this case, the connecting link 60 does not transmit the rotation of the lock arm 53 to the lever 59 because of a slot 53A positioned in the lock arm 53. Thus, the bypass valve 36 remains in the closed position when the swivel bracket 31 is in the tilted-down position. The swivel bracket 31 is prevented from moving toward the down direction by the action of the lower position stop pin 50 and toward the up direction by the closure of the bypass valve 36.

Figure 3:
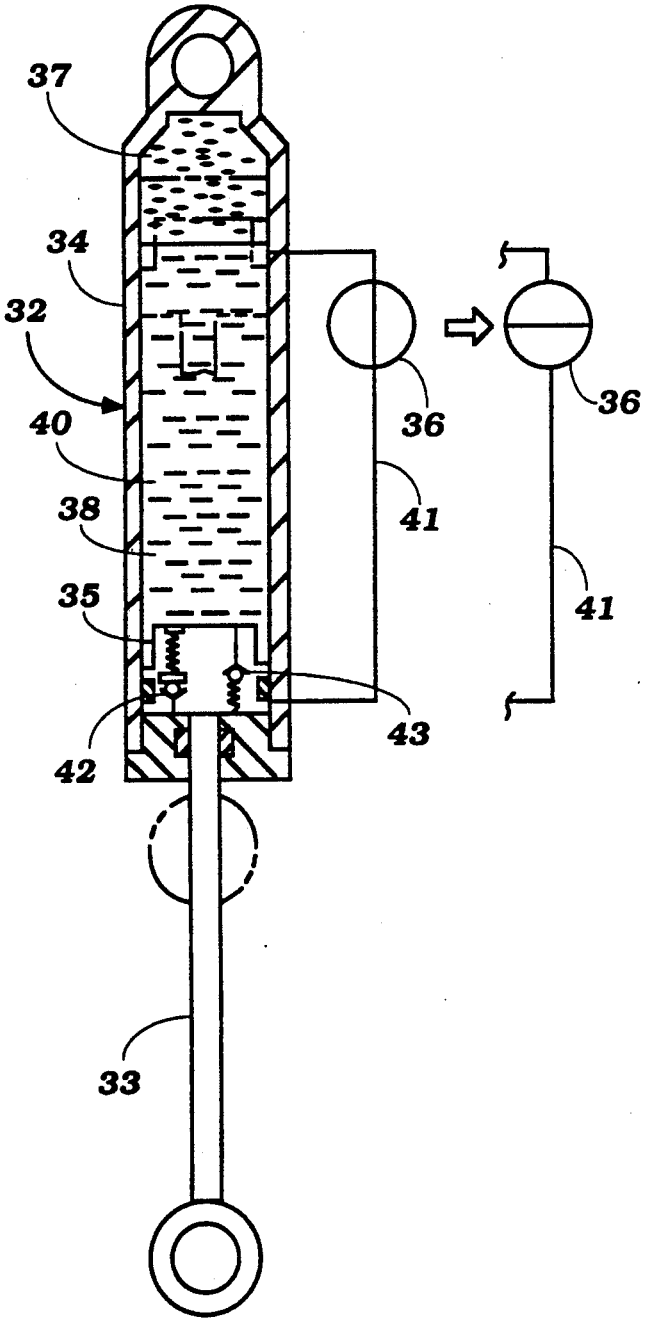
FIG. 3 is a schematic cross-sectional view of the position of a tilt cylinder device when the outboard drive unit is raised to its fully lifted position.
Figure 4:
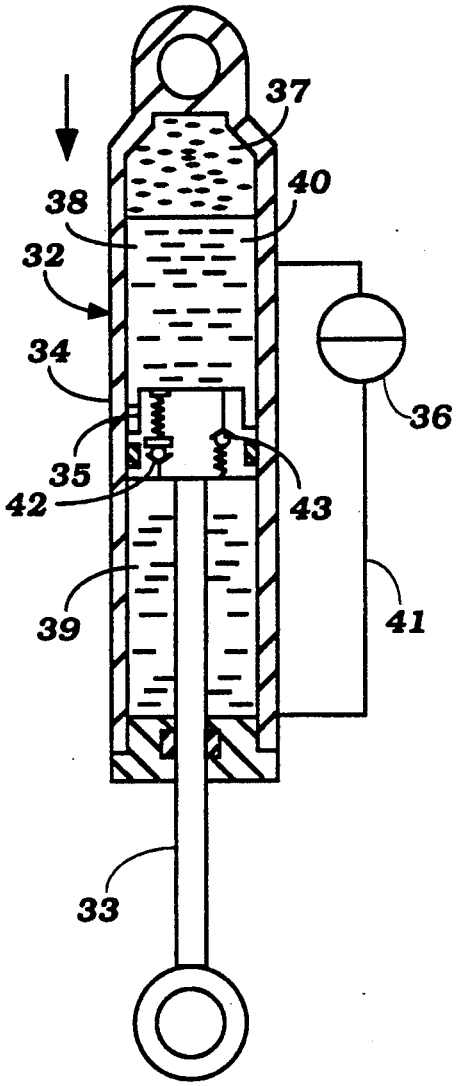
FIG. 4 is a schematic cross-sectional view of the position of the tilt cylinder device as it lowers the drive unit back to its normal running position.

The function of the tilt cylinder device 32 is shown in FIGS. 3 and 4. When a piston 35 is fully retracted upwardly into the cylinder 34, the bypass valve 36 is closed, and an assist gas 37 is compressed, such as would occur when the drive unit 10 is lowered into down or running position shown in solid lines in FIG. 1. In this condition, any rearwardly directed forces on the drive unit 10 such as those normally resulting from decelerating of the vessel or running the drive unit 10 in reverse would tend to urge the cylinder 34 in an upward direction relative to the rod 33 and the piston 35. Because the bypass valve 36 is closed, a working fluid 38 in an annular chamber 39 cannot flow through a bypass passage 41, and thus the downward force of the piston 35 causes the working fluid pressure in the annular chamber 39 to increase. However, the increased pressure in the annular chamber 39 resulting from such rearward forces on the drive unit 10 is not normally sufficient to open a first check valve 42. Therefore, the working fluid 38 in the annular chamber 39 is trapped, and any upward movement of the cylinder 34 relative to the piston 35 is resisted, thereby maintaining the drive unit 10 in its downward or running position.

When the operator has opened the bypass valve 36 so as to tilt the drive unit 10 upwardly to its lifted position, shown in broken lines in FIG. 1, for purposes of service or maintenance, the cylinder 34 is extended upwardly, thus reducing the volume of the annular chamber 39. The reduction in volume in the annular chamber 39 forces the working fluid 38 through the bypass passage into a cylindrical chamber 40.

If the drive unit 10 is tilted to its fully lifted position, the cylinder 34 moves upwardly such that the rod 33 and the piston 35 force virtually all of the working fluid 38 into the cylindrical chamber 40 as is illustrated in FIG. 3. The upward movement of the cylinder 34 is assisted by the pressure of the assist gas 37 to relieve the operator from the necessity of lifting the full weight of the drive unit 10. The pressure is not so high, however, to lift the drive unit 10 by itself. The assist gas 37 also expands to fill the volume of the cylinder 34 that is no longer occupied by the portion of the rod 33 that is extended out of the cylinder 34.

If the operator closes the bypass valve 36 while the rod 33 and the piston 35 are in an extended position and then releases the drive unit 10, the weight of the drive unit 10 exerts a force on the cylinder 34 in a downward direction relative to the piston 35. Such force is great enough to pressurize the cylindrical chamber 40 sufficiently to open a second check valve 43. The working fluid 38 is thus allowed to flow from the cylindrical chamber 40 through the second check valve 43 into the annular chamber 39, thereby allowing the rod 33 and the piston 35 to retract and dampingly lower the drive unit 10 to its down position. As the rod 33 and the piston 35 retract, the assist gas 37 is compressed to compensate for the volume of the cylinder 34 that is now occupied by the retracted rod 33.

In the event that the drive unit 10 collides with a submerged obstacle and the bypass valve 36 is closed, such a collision causes a sudden upward force on the cylinder 34, thereby increasing the working fluid pressure in the annular chamber 39 sufficient to open the first check valve 42. As a result, the working fluid 38 in the annular chamber 39 is forced through the first check valve 42 into the cylindrical chamber 40. The cylinder 34 extends upwardly, allowing the drive unit 10 to swing upwardly to prevent, or at least minimize, the impact damage to the drive unit 10. As the cylinder 34 extends upwardly, the assist gas 37 expands to compensate for the volume of the cylinder 34 formally occupied by the rod 33.

After the vessel has passed the submerged object and the drive unit 10 is released, the weight of the drive unit 10 urges the cylinder 34 downward relative to the piston 35, thus closing the first check valve 42 and pressurizing the cylindrical chamber 40 sufficiently to open the second check valve 43 as illustrated in FIG. 4. The working fluid 38 in the cylindrical chamber 40 is then forced through the second check valve 43 into the annular chamber 39, allowing the cylinder 34, to retract downwardly and dampenly return the drive unit 10 to its lowered or running position.

Figure 5:
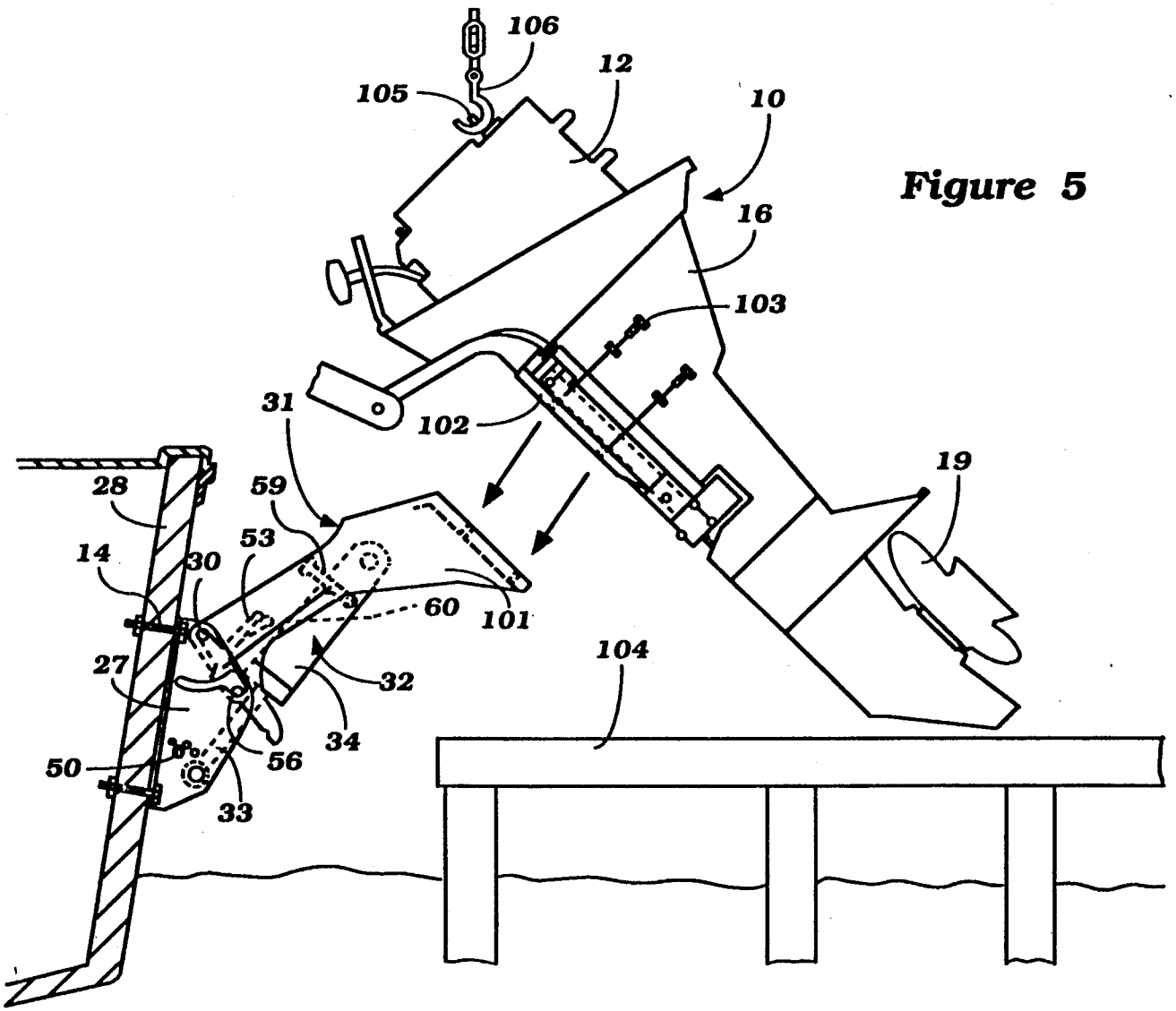
FIG. 5 is a schematic illustration of detaching and attaching of the drive unit from a marine vessel.

FIG. 5 shows the preferred embodiment of the invention, wherein the second piece of the swivel bracket 102 is detached or separated from the first piece 101, allowing the drive unit 10 to be easily demounted or separated from the hull 28 of the marine vessel 29 at a dock 104 or other suitable demounting place. When the drive unit 10 is in the tilted-up position, as shown in FIG. 5, it can be positioned above the dock 104 for removal.

The tilting up of the drive unit 10 is assisted by the pressure of the assist gas 37 to relieve the operator from the necessity of lifting the full weight of the drive unit 10. The pressure is not so high, however, to lift the drive unit 10 by itself. When the second piece of the swivel bracket 102 is separated or detached from the first piece of the swivel bracket 101 and when the drive unit 10 is demounted or separated from the hull 28 of the marine vessel 29, the pressure of the assist gas 37 is high enough to maintain the first piece of the swivel bracket 101 in a tilted-up position, as shown in FIG. 5. Thus, the pressure of the assist gas 37 can be used to assist in mounting and demounting the drive unit 10.

The cowling 13 is removed from the power head 11, exposing the engine 12. A first hook 105 is affixed to the engine 12, and is engageable with a second hook 106, which is affixed to a suitable lifting source. The second piece of the swivel bracket 102 can then be detached from the first piece 101 by removing the connecting bolts 103, thereby permitting the drive unit 10 to be easily demounted from the marine vessel 29.

The foregoing descriptions represent merely exemplary embodiments of the invention. Furthermore, although the invention is described herein within the context of outboard marine drive units, the invention is not limited to such an application. One reasonably skilled in the art will readily recognize that the invention is equally applicable to other apparatus or systems having tiltable or pivotable articulated elements. Finally, various changes or modifications may be made in said embodiments without departing from the spirit or scope of the invention.

I claim:

1. An outboard drive unit carrying propelling means for propelling a marine vessel having a hull through the water, said outboard drive unit further comprising a drive shaft housing including a steering shaft, a clamp bracket attached to the hull of said vessel, a tilt shaft, a swivel bracket having a first piece and a second piece, each of the pieces having a connecting face, the first piece of said swivel bracket pivotally secured to said clamp bracket by said tilt shaft, the second piece of said swivel bracket rotatably secured to said steering shaft of said drive shaft housing for steering movement, connecting means for connecting the connecting faces of the first and second pieces of said swivel bracket such that the first and second pieces of said swivel bracket are able to be separated from one another and such that at least the top edge of the connecting faces is below said tilt shaft when said outboard drive unit is in a tilted-down position and above said tilt shaft when said outboard drive unit is in a tilted-up position, the connecting face of the first piece facing upwardly and rearwardly when said outboard drive unit is in the tilted-up position, thereby allowing said outboard drive unit to be easily detached from the hull of said vessel, said clamp bracket having a slot said slot having a stop surface and a stop pin engagable with the stop surface to maintain the first piece of said swivel bracket in the tilted-up position.

2. An outboard drive unit as recited in claim 1, further comprising a tilt cylinder device having one end secured to said clamp bracket and the other end secured to the first piece of said swivel bracket.

3. An outboard drive unit as recited in claim 2, wherein said connecting means comprise bolts.

4. An outboard drive unit as recited in claim 3, wherein said tilt cylinder device includes a cylinder, a piston and a rod slidably moveable within said cylinder.

5. An outboard drive unit as recited in claim 4, wherein said tilt cylinder device includes an assist gas and a working fluid.

6. An outboard drive unit as recited in claim 5, wherein the pressure of said assist gas is high enough to assist in the tilting up of said drive unit but not high enough to lift said drive unit by itself.

7. An outboard drive unit as recited in claim 6, wherein the pressure of said assist gas is high enough to maintain the first piece of said swivel bracket in the tilted-up position when the second piece of said swivel bracket is separated from the first piece of said swivel bracket and said drive unit is separated from the hull of said marine vessel.

8. An outboard drive unit as recited in claim 2, wherein said tilt cylinder device is adapted to maintain said outboard drive unit in a downward position during normal operation of said drive unit.

* * * * *